United States Patent [19]

Schinke

[11] 4,421,056

[45] Dec. 20, 1983

[54] NOZZLE FOR APPLYING A LIQUID TO THE INTERMEDIATE IMAGE CARRIER OF AN ELECTROPHORETIC PRINTER

[75] Inventor: Franz Schinke, Hamburg, Fed. Rep. of Germany

[73] Assignee: U.S. Philips Corporation, New York, N.Y.

[21] Appl. No.: 357,246

[22] Filed: Mar. 11, 1982

[30] Foreign Application Priority Data

Mar. 26, 1981 [DE] Fed. Rep. of Germany ..... 3111893

[51] Int. Cl.[3] ..... G03G 15/01

[52] U.S. Cl. ..... 118/645; 118/652; 134/198; 355/4

[58] Field of Search ..... 118/652, 645, DIG. 4, 118/407, 411, 412; 430/125; 355/4, 15; 427/420; 239/193, 590.3, 590.5; 134/172, 198

[56] References Cited

FOREIGN PATENT DOCUMENTS 2299921 9/1976 France ..... 118/407

*Primary Examiner*—John P. McIntosh
*Assistant Examiner*—Mary Beth Calligaris
*Attorney, Agent, or Firm*—Norman N. Spain

[57] ABSTRACT

In order to prevent clogging of the nozzle and to ensure that the intermediate image carrier (8) is uniformly wetted with toner suspension across its entire width directly at the beginning of the printing operation, the nozzle comprises a front chamber (3) which extends across the entire width of the intermediate image carrier (8). Toner suspension enters said front chamber and subsequently reaches, via narrow bores (4), an open rear chamber (5) which is filled with suspension as far as an overflow edge (6). At the beginning of the operation, the suspension flows over the edge (6), across an inclined surface (7) in order to be applied to the intermediate image carrier (8) in a film of given thickness. The thickness of the suspension film is determined by a gap (10) which is formed by the nozzle and the intermediate image carrier (8). The nozzle has a flat shape, so that several nozzles can be arranged over one another.

8 Claims, 3 Drawing Figures

Figure 1:
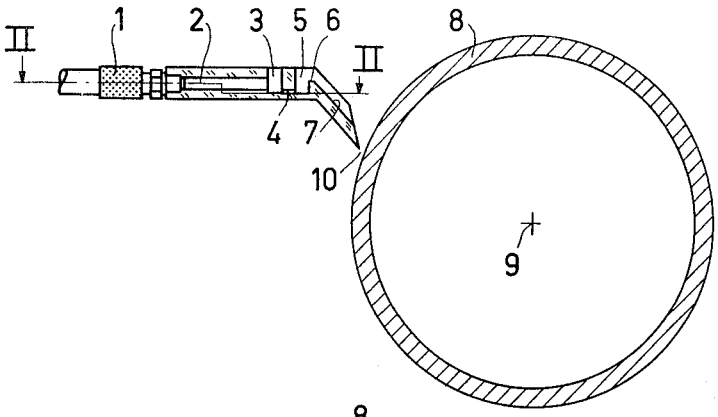

NOZZLE FOR APPLYING A LIQUID TO THE INTERMEDIATE IMAGE CARRIER OF AN ELECTROPHORETIC PRINTER

The invention relates to a nozzle for applying liquid, notably a toner suspension or a cleaning liquid, to an intermediate image carrier of an electrophoretic printer, said liquid entering the nozzle via an inlet opening near one end and emerging therefrom near the other end via a wide discharge opening, so that it is applied to the intermediate image carrier in front of the electrodes, viewed in the transport direction of the intermediate image carrier.

The storage, processing, transfer and recording of images or characters has become very important in the field of technical data processing. Notably the importance of non-mechanical reproduction of electrically stored information on conventional image carriers, for example, paper has grown. The aim is inter alia to improve the quality of the recorded images.

German Offenlegungsschrift 29 44 708 already describes a method of and a device for the electrophoretic reproduction of multicolor images. Therein, for each colour of the toner suspension there is provided a separate nozzle in order to apply the relevant toner suspension to the drum-shaped image carrier. In the nozzles used, the toner suspension flows, via a bore into a chamber which extends across the entire width of the intermediate image carrier and which comprises a narrow opening wherethrough the toner suspension is applied to the intermediate image carrier.

This nozzle is liable to be completely or partly clogged, thus causing an uncontrollable, irregular application of the toner suspension to the intermediate image carrier. Moreover, the thickness of the suspension film applied to the intermediate image carrier can be influenced only by control of the feed rate of the pump associated with each nozzle. This requires a comparatively complex construction in order to prevent irregular operation of the pump, for example, due to mains voltage fluctuations.

Furthermore, after the starting of the printing operation the intermediate image carrier is irregularly wetted with toner suspension for at least a brief period of time, because the space situated in front of the discharge opening is irregularly filled with toner suspension, so that the toner suspension is also irregularly ejected from the discharge opening of the nozzle, viewed across the full width of the intermediate image carrier.

It is an object of the invention to improve the quality of electrophoretically printer colour images by constructing the nozzle for the supply of toner suspension so that it functions correctly and a uniform supply of suspension across the entire width of the intermediate image carrier is ensured right from the start.

To this end, the nozzle in accordance with the invention is characterized in that it successively comprises, viewed in the flow direction of the liquid, a front chamber and an open rear chamber which communicates with the front chamber via a plurality of comparatively narrow bores, said rear chamber being situated near the end where the discharge opening of the nozzle is situated, the boundary between the rear chamber and the discharge opening being formed by a raised overflow edge which extends across the entire width of the discharge opening and which is arranged to be higher than the bores, the discharge opening comprising an inclined surface which extends from the rear chamber as far as the vicinity of the intermediate image carrier and which forms a comparatively narrow gap in conjunction with the intermediate image carrier, the front chamber, the rear chamber and the inclined surface extending across the entire width of the intermediate image carrier. The advantage of this device consists in that the speed of the toner suspension flowing through the nozzle remains constant. This is a condition to be satisfied for a uniform and controllable thickness of the applied toner suspension film.

A further embodiment of the device is characterized in that the gap between the inclined surface and the intermediate image carrier has the same width over its entire length. The width of the gap between the nozzle and the intermediate image carrier is preferably adjustable. This simple mechanical step ensures that the thickness of the suspension film applied to the intermediate image carrier always remains constant. Moreover, the thickness of the suspension film can thus be controlled without an elaborate construction being required.

A preferred embodiment of a printer for multicolour printing is characterized in that for each toner suspension there is provided a nozzle, several of such nozzles being arranged over one another in order to form a toner unit. This results in a space-saving lay-out of the multicolour printer and, moreover, contributes to the desirable compact construction.

A further embodiment of the multicolour printer in accordance with the invention is characterized in that the gaps between the individual nozzles of the toner unit and the intermediate image carrier have a different width, the gap formed between the lower most nozzle of the toner unit and the intermediate image carrier being the narrowest, the width of this gap being equal to the toner suspension film thickness required for suitable electrophoretic printing. This design enables a large number of such nozzles of the same construction to be arranged over one another on a very small surface area.

Figure 2:
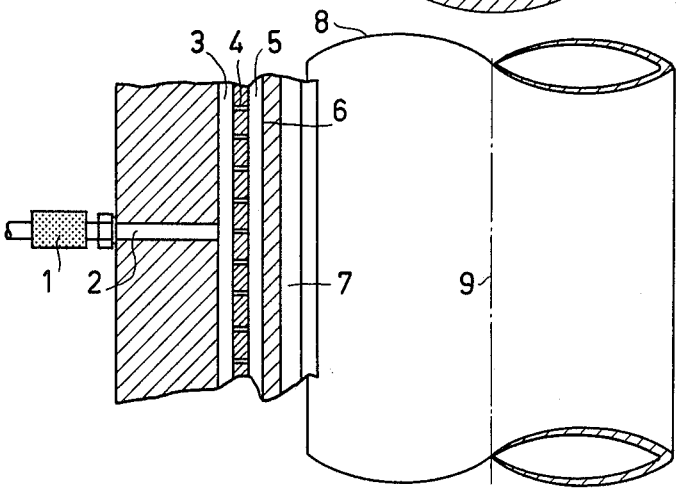
Figure 3:
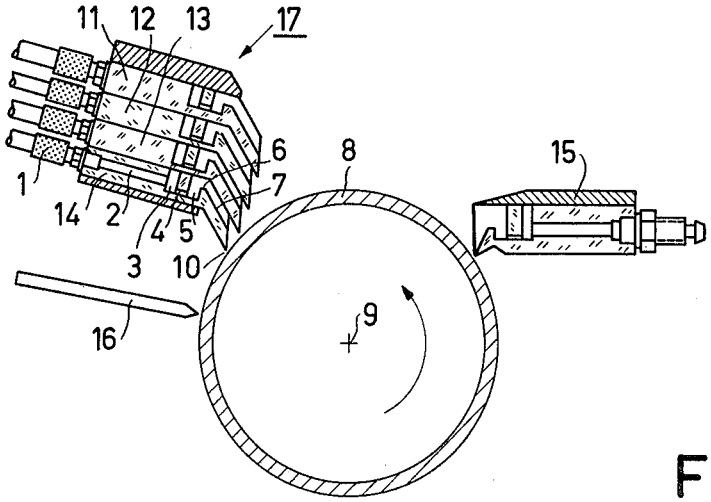

Some embodiments will be described in detail hereinafter with reference to the drawing. Therein:

FIG. 1 is a sectional view of a separate nozzle and an intermediate image carrier, FIG. 2 is a partial sectional and plan view of the nozzle and the intermediate image carrier shown in FIG. 1, and FIG. 3 is a sectional view of a device for multicolour printing which comprises several nozzles and an intermediate image carrier.

In the embodiment of a nozzle in accordance with the invention which is shown in FIG. 1, the toner suspension reaches, via a connection 1 and a bore 2, a front chamber 3 which extends across the entire width of an intermediate image carrier 8. As is clearly shown in FIG. 2, the toner suspension is distributed in the front chamber 3 before it reaches an open rear chamber 5 via bores 4. The rear chamber 5 also extends across the entire width of the intermediate image carrier and comprises an overflow edge 6. Consequently, the rear chamber 5 is always filled with toner suspension up to the overflow edge 6, so that the suspension in the rear chamber 5 is ready for the printing operation at the overflow edge 6. At the start of the printing operation, the toner suspension directly flows uniformly across the entire inclined surface 7 and onto an intermediate image carrier 8.

FIG. 2 shows clearly that the front chamber 3, the rear chamber 5 and the inclined surface 7 extend parallel to the axis 9 of the cylindrical intermediate image carrier 8.

FIG. 1 shows a gap 10 between the inclined surface 7 and the intermediate image carrier 8 which determines the thickness of the toner suspension film. The width of this gap is the constant over its entire length and is preferably adjustable by means of adjusting means (not shown).

The printing of multicolour images requires several nozzles 11,12,13,14 as shown in FIG. 1 for the supply of toner suspensions of different colour; these nozzles may be combined to form a toner unit 17 as diagrammatically shown in FIG. 3. In addition to the nozzles for the coloured toner suspensions, a further nozzle 15 having a similar construction may be provided for a cleaning liquid, said further nozzle preferably being arranged at the opposite side of the intermediate image carrier 8. In order to apply toner suspension as well as cleaning liquid to the intermediate image carrier, the toner unit 17 with the nozzles 11,12,13, 14 for the supply of toner suspensions of different colour as well as the nozzle 15 for the supply of cleaning liquid must be arranged at a level which is higher than the axis 9 of the intermediate image carrier 8. The coloured toner is electrophoretically deposited on the intermediate image carrier 8 by means of an electrode 16.

FIG. 3 shows that the nozzles 11, 12, 13, 14 are arranged so that the gaps between the inclined surface 7 of the nozzles and the intermediate image carrier 8 have a different width, the gap 10 between the lower most nozzle 14 and the intermediate carrier being the narrowest. The width of the gap 10 is chosen so that it equals the toner suspension film thickness required for suitable electrophoretic printing. The gap 10 thus also determines the thickness of the suspension film from the nozzles 11,12 and 13.

What is claimed is:

1. An apparatus for applying liquid to an intermediate image carrier of an electrophoretic printer comprising the combination of an intermediate image carrier of an electrophoretic printer, said image carrier being movable in a given direction, a nozzle for applying liquid, in particular a toner suspension or a cleaning liquid, to a surface of said image carrier, said nozzle comprising inlet means for said liquid and discharge means for said liquid, the discharge means having a width larger than the diameter of the inlet means, said nozzle being positioned sufficiently close to said image carrier so as to provide a narrow gap (10) between said nozzle and said surface, and at least one electrode positioned in the vicinity of the surface of said image carrier for applying a static charge to said surface prior to the application of liquid from said nozzle to said surface, characterized in that said nozzle comprises, viewed in the direction of the movement to said surface, an inlet means for receiving liquid from a supply thereof, a front chamber (3), having a width corresponding to the width of the intermediate image carrier for receiving liquid from said inlet means, passage means for providing access for flow of said liquid between said inlet means and said front chamber (3), a rear chamber (5), having a width corresponding to the width of the intermediate image carrier located in front of said front chamber (3) in the direction of said liquid flow, a plurality of bore means (4) for providing access for flow of said liquid from said front chamber (3) to said rear chamber (5), the diameter of each of said bore means (4) being smaller then the widths of said chambers, said rear chamber (5) being situated near said discharge means and separated from said discharge means by a raised overflow edge (6), the height of said overflow edge (6) being higher than that of said bore means (4), said discharge means comprising an inclined surface (7) extending from said rear chamber (5) in the direction of said surface of said image carrier and terminating sufficiently close to said surface to provide a narrow gap (10) between said surface of said intermediate image carrier and said inclined surface (7), and each of said front chamber (3), said rear chamber (5), said overflow edge (5) and said inclined surface (7) extending across the entire width of the surface of said intermediate image carrier.

2. A nozzle as claimed in claim 1, characterized in that the front chamber (3), the rear chamber (5) and the inclined surface (7) extend parallel to an axis (9) of the intermediate image carrier (8).

3. A nozzle as claimed in claim 1 or 2, characterized in that the gap (10) between the inclined surface (7) and the intermediate carrier (8) has the same width over its entire length.

4. A nozzle as claimed in claim 1, characterized in that the width of the gap (10) between the inclined surface (7) and the intermediate image carrier (8) is adjustable.

5. A multicolour printer comprising at least two nozzles as claimed in claim 1, characterized in that for each toner suspension there is provided a nozzle, several of such nozzles (11,12,13,14) being arranged over one another in order to form a toner unit (17).

6. A device as claimed in claim 5, characterized in that the toner unit (17) is arranged at a level which is higher than that of the axis (9) of the intermediate image carrier (8).

7. A device as claimed in claim 5 or 6, characterized in that the toner unit (17) is arranged at one side of the intermediate image carrier (8), a nozzle (15) for a cleaning liquid being arranged at the other side of the intermediate image carrier (8).

8. A device as claimed in claim 7, characterized in that the gaps between the individual nozzles of the toner unit (17) and the intermediate image carrier (8) have a different width, the gap (10) which is formed by the lowermost nozzle (14) of the toner unit (17) and the intermediate image carrier (8) being the narrowest gap, the width of the gap (10) being equal to the toner suspension film thickness required for suitable electrophoretic printing.

* * * * *